US010428674B2

(12) United States Patent
Sippel et al.

(10) Patent No.: US 10,428,674 B2
(45) Date of Patent: Oct. 1, 2019

(54) GAS TURBINE ENGINE FEATURES FOR TIP CLEARANCE INSPECTION

(71) Applicants: Rolls-Royce Corporation, Indianapolis, IN (US); Rolls-Royce North American Technologies, Inc., Indianapolis, IN (US)

(72) Inventors: Aaron D. Sippel, Zionsville, IN (US); Brian J. Shoemaker, Indianapolis, IN (US); Ted J. Freeman, Danville, IN (US)

(73) Assignees: Rolls-Royce North American Technologies Inc., Indianapolis, IN (US); Rolls-Royce Corporation, Indianapolis, IN (US)

( * ) Notice: Subject to any disclaimer, the term of this patent is extended or adjusted under 35 U.S.C. 154(b) by 285 days.

(21) Appl. No.: 15/420,793

(22) Filed: Jan. 31, 2017

(65) Prior Publication Data

US 2018/0216481 A1 Aug. 2, 2018

(51) Int. Cl.
*F01D 11/12* (2006.01)
*F01D 21/00* (2006.01)

(52) U.S. Cl.
CPC ..... *F01D 11/122* (2013.01); *F01D 21/003* (2013.01); *F05D 2230/90* (2013.01); *F05D 2240/11* (2013.01); *F05D 2260/80* (2013.01); *F05D 2300/6033* (2013.01)

(58) Field of Classification Search
CPC ..... F01D 11/12; F01D 11/122; F01D 21/003; F05D 2300/6033; F05D 2260/80; F05D 2230/90; F05D 2240/11
USPC ..... 415/173.4, 174.4
See application file for complete search history.

(56) References Cited

U.S. PATENT DOCUMENTS 4,466,772 A * 8/1984 Okapuu ..... F01D 11/08 415/171.1
6,203,021 B1 * 3/2001 Wolfla ..... C23C 4/18 277/415
6,703,137 B2 * 3/2004 Subramanian ..... C23C 4/18 416/241 B
7,270,890 B2 9/2007 Sabol et al.
7,584,669 B2 9/2009 Dankert et al.
7,891,938 B2 2/2011 Herron et al.
(Continued)

FOREIGN PATENT DOCUMENTS

EP 2990660 A1 * 3/2016 ..... F01D 11/122
EP 3037394 A1 6/2016
WO 2013050688 A1 4/2013

*Primary Examiner* — Nathan C Zollinger
(74) *Attorney, Agent, or Firm* — Barnes & Thornburg LLP

(57) ABSTRACT

Turbine assemblies for a turbine of a gas turbine engine are disclosed herein. The turbine assembly includes a turbine wheel assembly and a turbine shroud. The turbine wheel assembly includes a disk and a plurality of blades that extend outwardly from the disk in a radial direction away from an axis. The turbine shroud extends around the blades of the turbine wheel assembly to block gasses from passing over the blades during operation of the turbine assembly. The turbine shroud includes a plurality of blade track segments arranged circumferentially adjacent to one another about the axis to form a ring. Each blade track segment has a runner that forms a primary track surface facing the axis and spaced from the axis in the radial direction.

20 Claims, 3 Drawing Sheets

(56) References Cited

U.S. PATENT DOCUMENTS 8,061,978 B2 * 11/2011 Tholen ..... C23C 4/18 415/173.1
8,079,806 B2 * 12/2011 Tholen ..... F01D 11/125 415/171.1
8,177,494 B2 * 5/2012 Ward ..... F01D 11/122 415/173.1
8,313,283 B2 11/2012 Morimoto
8,322,973 B2 12/2012 Shang et al.
8,684,669 B2 * 4/2014 Chehab ..... F01D 11/122 415/118
8,777,558 B2 * 7/2014 Brunet ..... F04D 29/164 415/173.1
8,915,711 B2 * 12/2014 Billotey ..... F04D 29/289 416/183
8,939,706 B1 * 1/2015 Lee ..... F01D 11/122 415/1
8,939,716 B1 * 1/2015 Lee ..... F01D 11/122 415/173.1
9,151,175 B2 * 10/2015 Tham ..... F01D 11/122
9,243,511 B2 * 1/2016 Lee ..... F01D 11/122
9,556,743 B2 * 1/2017 Chamberlain ..... C04B 41/85
9,829,005 B2 * 11/2017 Jactat ..... F04D 27/001
10,072,518 B2 * 9/2018 Playford ..... F01D 11/122
10,125,625 B2 * 11/2018 Maire ..... F01D 11/003
10,190,435 B2 * 1/2019 Lee ..... F01D 11/122
10,267,173 B2 * 4/2019 Webb ..... F01D 5/282
2003/0175116 A1 * 9/2003 Le Biez ..... F01D 5/20 415/173.4
2007/0147989 A1 * 6/2007 Collins ..... F01D 11/02 415/173.1
2012/0207586 A1 8/2012 Chehab et al.
2014/0076037 A1 3/2014 Warren et al.
2014/0199163 A1 7/2014 Lee
2015/0086334 A1 * 3/2015 Jactat ..... F04D 27/001 415/118
2016/0003092 A1 1/2016 Chamberlain et al.
2016/0061050 A1 * 3/2016 Keenan ..... F01D 11/122 415/118
2016/0115816 A1 4/2016 Webb et al.
2017/0037739 A1 * 2/2017 Maire ..... F01D 11/003
2018/0252117 A1 * 9/2018 Warren ..... F01D 21/003

* cited by examiner

GAS TURBINE ENGINE FEATURES FOR TIP CLEARANCE INSPECTION

FIELD OF THE DISCLOSURE

The present disclosure relates generally to gas turbine engines, and more specifically to turbine shrouds included in gas turbine engines.

BACKGROUND

Gas turbine engines typically include a compressor, a combustor, and a turbine. The compressor compresses air drawn into the engine and delivers high pressure air to the combustor. In the combustor, fuel is mixed with the high pressure air and the air/fuel mixture is ignited. Products of the combustion reaction in the combustor are directed into the turbine where work is extracted to drive various components of the gas turbine engine.

Turbines typically include alternating stages of static vane assemblies and rotatable wheel assemblies. The rotatable wheel assemblies include disks carrying blades that are coupled to the disks. When the rotatable wheel assemblies turn in response to receiving the combustion reaction products, tips of the blades move along ceramic blade tracks included in static turbine shrouds surrounding the rotating wheel assemblies. Consequently, work is extracted in the form of mechanical energy.

Clearance between the tips of the blades and the static turbine shrouds affects gas turbine engine operating efficiency. Optimizing the clearance between the tips of the blades and the static shrouds to maximize gas turbine engine operating efficiency, however, can present challenges. For example, to determine the clearance between the blade tips and the static shrouds, disassembly of the gas turbine engine is often required to inspect those components, thereby resulting in increased downtime during the repair and/or testing of gas turbine engines.

SUMMARY

The present disclosure may comprise one or more of the following features and combinations thereof.

According to the present disclosure, a turbine assembly may include a turbine wheel assembly and a turbine shroud. The turbine wheel assembly includes a disk and a plurality of blades that extend outwardly from the disk in a radial direction away from an axis. The turbine shroud extends around the blades of the turbine wheel assembly to block gasses from passing over the blades during operation of the turbine assembly.

In illustrative embodiments, the turbine shroud may be a full hoop or may include a plurality of blade track segments arranged circumferentially adjacent to one another about the axis to form a ring. Each blade track segment may have a runner that forms a primary track surface facing the axis that is spaced from the axis in the radial direction. At least one of the plurality of blade track segments may include a first set of rub depth indicators spaced from one another and each having a first depth measured from the primary track surface and a second set of rub depth indicators spaced from one another and each having a second depth measured from the primary track surface. The first set of rub depth indicators and the second set of rub depth indicators are configured such that approximate rub depths of the turbine wheel assembly into the turbine shroud caused by turbine wheel assembly rotation within the turbine shroud during operation of the turbine assembly may be determined based on visual observation of the first set of rub depth indicators and the second set of rub depth indicators.

In illustrative embodiments, the first set of rub depth indicators may be arranged along a first pathway in a first direction such that the first depths successively increase as the first set of rub depth indicators are located adjacent to one another in the first direction. The second set of rub depth indicators may be arranged in the first direction along a second pathway such that the second depths successively decrease as the second set of rub depth indicators are located adjacent to one another in the first direction These and other features of the present disclosure will become more apparent from the following description of the illustrative embodiments.

DETAILED DESCRIPTION OF THE DRAWINGS

Figure 1:
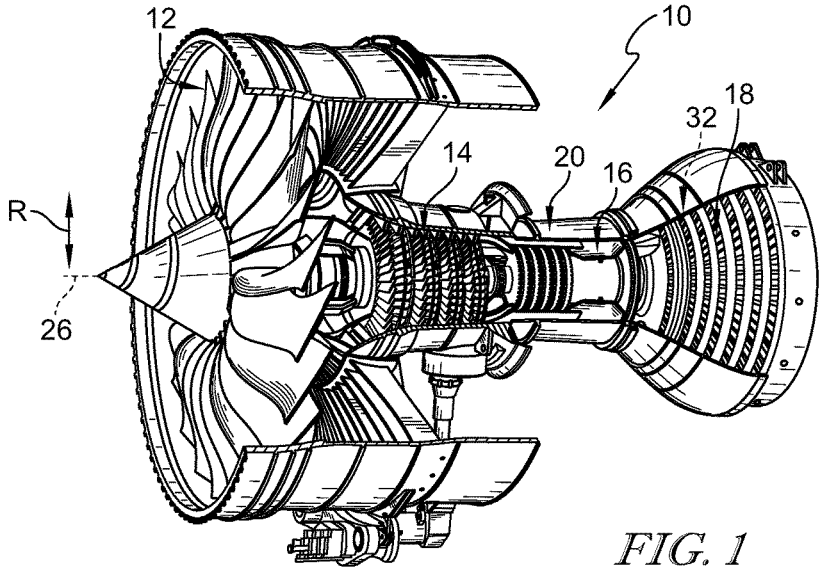
FIG. 1 is a cut-away perspective view of a gas turbine engine showing that the engine includes a turbine section.

For the purposes of promoting an understanding of the principles of the disclosure, reference will now be made to a number of illustrative embodiments illustrated in the drawings and specific language will be used to describe the same.

Referring now to FIG. 1, an illustrative gas turbine engine 10 includes a fan 12, a compressor 14, a combustor 16, and a turbine 18, each of which is surrounded and supported by a metallic case 20. The compressor 14 compresses and delivers air to the combustor 16. The combustor 16 mixes the compressed air with fuel, ignites the air/fuel mixture, and delivers the combustion products (i.e., hot, high-pressure gases) to the turbine 18. The turbine 18 converts the combustion products to mechanical energy (i.e., rotational power) that drives, among other things, the fan 12 and the compressor 14.

Figure 2:
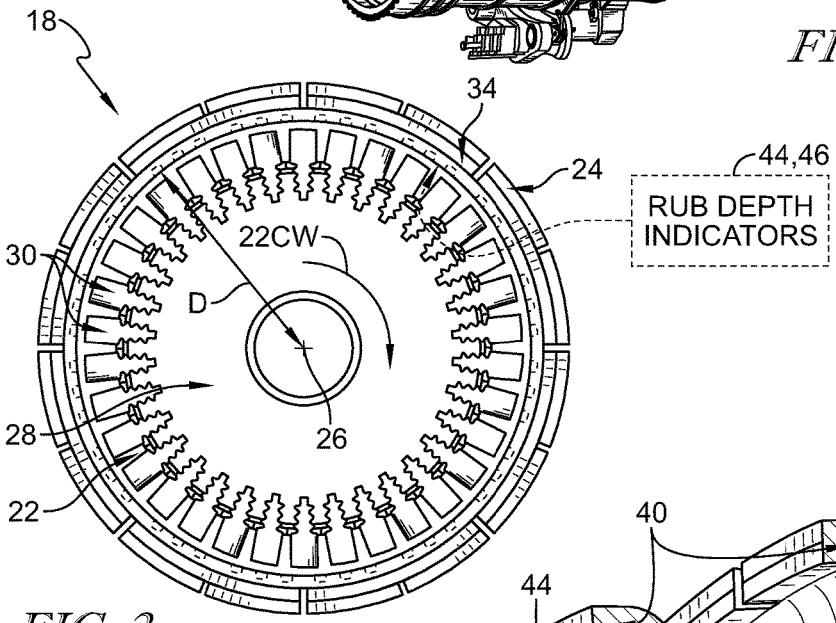
FIG. 2 is a front elevation view of a portion of a turbine assembly included in the turbine section of FIG. 1 showing a rotatable wheel assembly surrounded by a static shroud formed at least in part by a plurality of blade track segments and suggesting that at least one of the blade track segments includes a plurality of rub depth indicators configured to provide an indication of approximate rub depths of the wheel assembly into the shroud during operation of the turbine assembly.

Referring now to FIG. 2, the illustrative turbine 18 (also referred to herein as the turbine assembly 18) includes a turbine wheel assembly 22 and a turbine shroud 24 surrounding the turbine wheel assembly 22. The turbine shroud 24 blocks gasses from passing over the turbine wheel assembly 22 without causing the turbine wheel assembly 22 to rotate about an axis 26 as indicated by arrow 22CW, thereby contributing to lost performance within the gas turbine engine 10.

The illustrative turbine wheel assembly 22 includes a disk 28 and blades 30 extending outwardly from the disk 28 in a radial direction indicated by arrow R away from the axis 26 as shown in FIG. 2. The illustrative turbine shroud 24 includes a metallic carrier 32 and a blade track 34 having arcuate blade track segments 36. The blade track segments 36 are arranged circumferentially adjacent to one another about the axis 26 to form the annular blade track 34 around the axis 26. The metallic carrier 32 is coupled to the blade track 34 around the axis 26. In operation, the metallic carrier 32 is coupled to the metallic case 20 so that the carrier 32 supports the blade track 34 relative to the metallic case 20.

Figure 3:
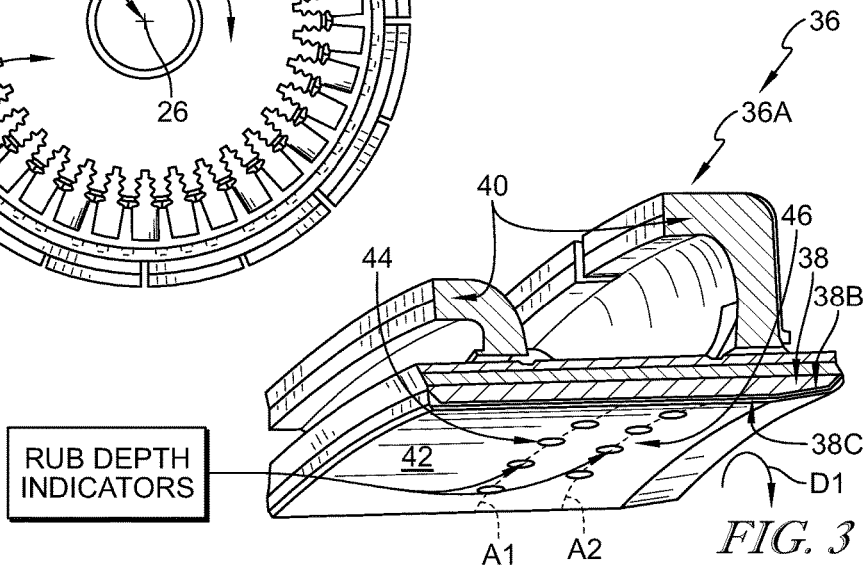
FIG. 3 is a perspective view of the at least one of the blade track segments of the shroud shown in FIG. 2 showing that the blade track segment includes a first set of rub depth indicators spaced from one another and each having a first depth measured from a primary track surface and a second set of rub depth indicators spaced from one another and each having a second depth measured from the primary track surface.

Each of the illustrative blade track segments 36 includes an arcuate runner 38 and an attachment feature 40 extending outward from the runner 38 in the radial direction as shown in FIG. 3. The runner 38 forms a primary track surface 42 facing the axis 26 and spaced a distance D from the axis 26 in the radial direction. The attachment feature 40 is configured to couple to the carrier 32.

The illustrative blade track segment 36A includes one set of rub depth indicators 44 and another set of rub depth indicators 46 formed in the primary track surface 42 as shown in FIGS. 2 and 3. Specifically, the sets of rub depth indicators 44, 46 are embodied as, or otherwise include, features that are machined into, and thus located internally of, the primary track surface 42.

The rub depth indicators 44 are spaced from one another and each have a depth 44D measured from the primary track surface 42 and the rub depth indicators 46 are spaced from one another and each have a depth 46D measured from the primary track surface 42 as shown in FIG. 3. The indicators 44, 46 are configured such that approximate rub depths of the turbine wheel assembly 22 into the turbine shroud 24 caused by rotation of the assembly 22 within the shroud 24 during operation of the turbine assembly 18 may be determined based on visual observation of the indicators 44, 46. As such, the indicators 44, 46 provide inspection features that may be used to determine rub (or a lack thereof) between the blades 30 and the blade track 34. Because the indicators 44, 46 may be visually observed using an optical device such as a borescope, interference between the blades 30 and the blade track 34 may be determined without disassembling the gas turbine engine 10 to examine the blades 30 and the blade track 34.

The illustrative set of rub depth indicators 44 are arranged along a linear pathway, illustratively an arc A1 in a direction indicated by arrow D1 as shown in FIG. 3. Specifically, as discussed in greater detail below, the rub depth indicators 44 are arranged along the arc A1 in the direction D1 such that the depths 44D of the indicators 44 successively increase as the indicators 44 are located adjacent to one another in the direction D1. The rub depth indicators 44 are circumferentially spaced from one another about the axis 26.

The illustrative set of rub depth indicators 46 are arranged along a linear pathway, illustratively an arc A2 in the direction D1 as shown in FIG. 3. Specifically, as discussed in greater detail below, the rub depth indicators 46 are arranged along the arc A2 in the direction D1 such that the depths 46D of the indicators 46 successively decrease as the indicators 46 are located adjacent to one another in the direction D1. The rub depth indicators 46 are circumferentially spaced from one another about the axis 26.

The blade track 34 is illustratively constructed of a ceramic matrix composite material. In one example, the ceramic matrix composite material may include silicon-carbide fibers formed into fabric sheets and a silicon-carbide matrix. In another example, the ceramic matrix composite material may include another ceramic-based material that including reinforcing fibers and a matrix material.

The runner 38 of the illustrative blade track segment 36A includes a base portion 38B and a coating 38C applied to the base portion 38B as shown in FIG. 3. In some embodiments, the coating 38C may be applied directly to an environmental barrier coating (not shown), and the environmental barrier coating may be applied directly to a bond coating (not shown) that is applied directly to the base portion 38C. In any case, the base portion 38B is formed from a ceramic matrix composite material and the coating 38C is formed from a ceramic-containing material.

The primary track surface 42 and the sets of rub depth indicators 44, 46 are illustratively formed by the coating 38C as shown in FIG. 3. The illustrative coating 38C is abradable and adapted to wear when the blades 30 rub into the coating 38C such that interference between the blades 30 and the blade track 34 can be determined as indicated above. The coating 38C is also adapted to withstand the high temperature gasses provided to the turbine assembly 18 during operation thereof. As such, in some embodiments, the coating 38C may be a protective coating such as an environmental barrier coating adapted to resist degradation and protect the base portion 38B during operation of the gas turbine engine 10.

Figure 4:
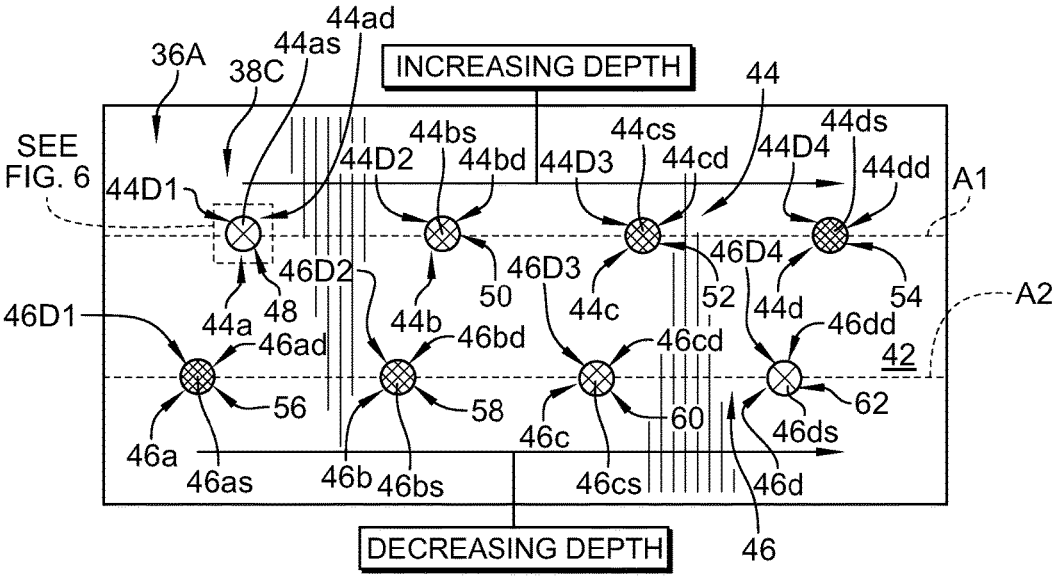
FIG. 4 is a bottom view of the blade track segment of FIG. 3 showing that the first set of rub depth indicators are arranged along a first arcuate pathway in a clockwise direction about a central axis of the turbine assembly such that the first depths successively increase as the first set of rub depth indicators are located adjacent to one another in the clockwise direction, and that the second set of rub depth indicators are arranged along a second arcuate pathway in the clockwise direction such that the second depths successively decrease as the second set of rub depth indicators are located adjacent to one another in the clockwise direction.

Referring now to FIG. 4, the set of rub depth indicators 44 illustratively includes four rub depth indicators 44*a*, 44*b*, 44*c*, 44*d* arranged along the arc A1 in the direction D1. The number of rub depth indicators 44 is dependent upon the operational application of the turbine assembly 18. In some embodiments, another suitable number of rub depth indicators 44 may be provided. In any case, the direction D1 is a clockwise circumferential direction about the axis 26. In other embodiments, the direction D1 may be a counterclockwise circumferential direction about the axis 26.

The illustrative rub depth indicators 44*a*, 44*b*, 44*c*, 44*d* have respective depths 44D1, 44D2, 44D3, 44D4 measured from the primary track surface 42 that are indicated by respective patterns 44*ad*, 44*bd*, 44*cd*, 44*dd* as shown in FIG. 4. The depth 44D2 indicated by the pattern 44*bd* is greater than the depth 44D1 indicated by the pattern 44*ad*. The depth 44D3 indicated by the pattern 44*cd* is greater than the depth 44D2 indicated by the pattern 44*bd*. The depth 44D4 indicated by the pattern 44*dd* is greater than the depth 44D3 indicated by the pattern 44*cd*.

The set of rub depth indicators 46 illustratively includes four rub depth indicators 46*a*, 46*b*, 46*c*, 46*d* arranged along the arc A2 in the direction D1 as shown in FIG. 4. The number of rub depth indicators 46 is dependent upon the operational application of the turbine assembly 18. In some embodiments, another suitable number of rub depth indicators 46 may be provided. In any case, the arc A1 and the arc A2 are spaced from one another along the axis 26.

The illustrative rub depth indicators 46*a*, 46*b*, 46*c*, 46*d* have respective depths 46D1, 46D2, 46D3, 46D4 measured from the primary track surface 42 that are indicated by respective patterns 46*ad*, 46*bd*, 46*cd*, 46*dd* as shown in FIG. 4. The depth 46D1 indicated by the pattern 46*ad* is greater than the depth 46D2 indicated by the pattern 46*bd*. The depth 46D2 indicated by the pattern 46*bd* is greater than the depth 46D3 indicated by the pattern 46*cd*. The depth 46D3 indicated by the pattern 46*cd* is greater than the depth 46D4 indicated by the pattern 46*dd*.

The illustrative rub depth indicators 44*a*, 44*b*, 44*c*, 44*d* form respective rub indication surfaces 44*as*, 44*bs*, 44*cs*, 44*ds* as shown in FIG. 4. The rub depth indication surfaces 44*as*, 44*bs*, 44*cs*, 44*ds* are located internally of the primary track surface 42. The rub depth indicators 44*a*, 44*b*, 44*c*, 44*d* are arranged in the direction D1 such that the surfaces 44*as*, 44*bs*, 44*cs*, 44*ds* are spaced successively farther from the axis 26 in the radial direction than the primary track surface 42 as the indicators 44*a*, 44*b*, 44*c*, 44*d* are located adjacent to one another in the direction D1. As such, the surface 44*as* is closer to the axis 26 than the surface 44*bs*, the surface 44*bs* is closer to the axis 26 that the surface 44*cs*, and the surface 44*cs* is closer to the axis than the surface 44*ds*.

The illustrative rub depth indicators 46*a*, 46*b*, 46*c*, 46*d* form respective rub indication surfaces 46*as*, 46*bs*, 46*cs*, 46*ds* as shown in FIG. 4. The rub depth indication surfaces 46*as*, 46*bs*, 46*cs*, 46*ds* are located internally of the primary track surface 42. The rub depth indicators 46*a*, 46*b*, 46*c*, 46*d* are arranged in a direction D2 generally opposite the direction D1 such that the surfaces 46*as*, 46*bs*, 46*cs*, 46*ds* are spaced successively farther from the axis 26 in the radial direction than the primary track surface 42 as the indicators 46*a*, 46*b*, 46*c*, 46*d* are located adjacent to one another in the direction D2. As such, the surface 46*as* is farther from the axis 26 that the surface 46*bs*, the surface 46*bs* is farther from the axis 26 than the surface 46*cs*, and the surface 46*cs* is farther from the axis 26 that the surface 46*ds*.

Figure 6:
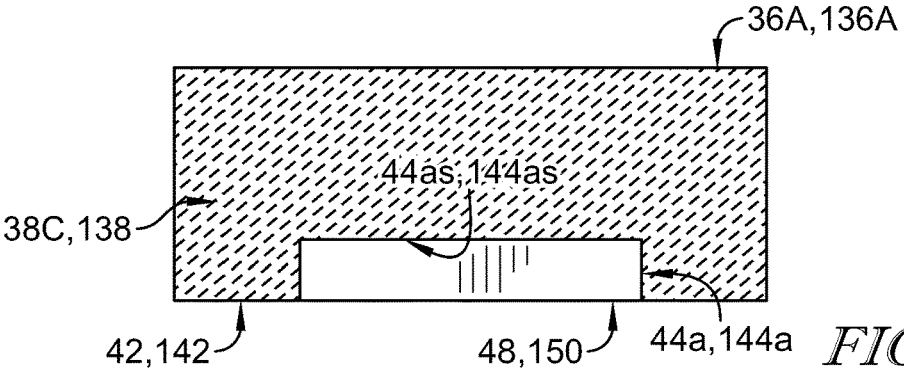
FIG. 6 is a sectional view of one of the rub depth indicators that is formed in the blade track segments of FIGS. 4 and 5.

Referring now to FIG. 6, the rub depth indicator 44*a* and the rub indication surface 44*as* are shown in greater detail. The rub depth indicator 44*a* illustratively has a generally circular cross-sectional shape as best seen in FIG. 4. In other embodiments, however, the rub depth indicator 44*a* may take the shape of another suitable geometric form. The rub indication surface 44*as* is illustratively a generally planar surface (also referred to herein as a flat-bottomed surface) defined by an aperture 48 formed in the coating 38C that has a generally circular cross-sectional shape.

In the illustrative embodiment, the rub depth indicators 44*b*, 44*c*, 44*d*, 46*a*, 46*b*, 46*c*, 46*d* have cross-sectional shapes substantially identical to the cross-sectional shape of the indicator 44*a* as shown in FIGS. 4 and 6. Additionally, in the illustrative embodiment, the rub indication surfaces 44*bs*, 44*cs*, 44*ds*, 46*as*, 46*bs*, 46*cs*, 46*ds* are generally planar surfaces defined by respective apertures 50, 52, 54, 56, 58, 60, 62 formed in the coating 38C that have cross-sectional shapes substantially identical to the aperture 48.

Figure 5:
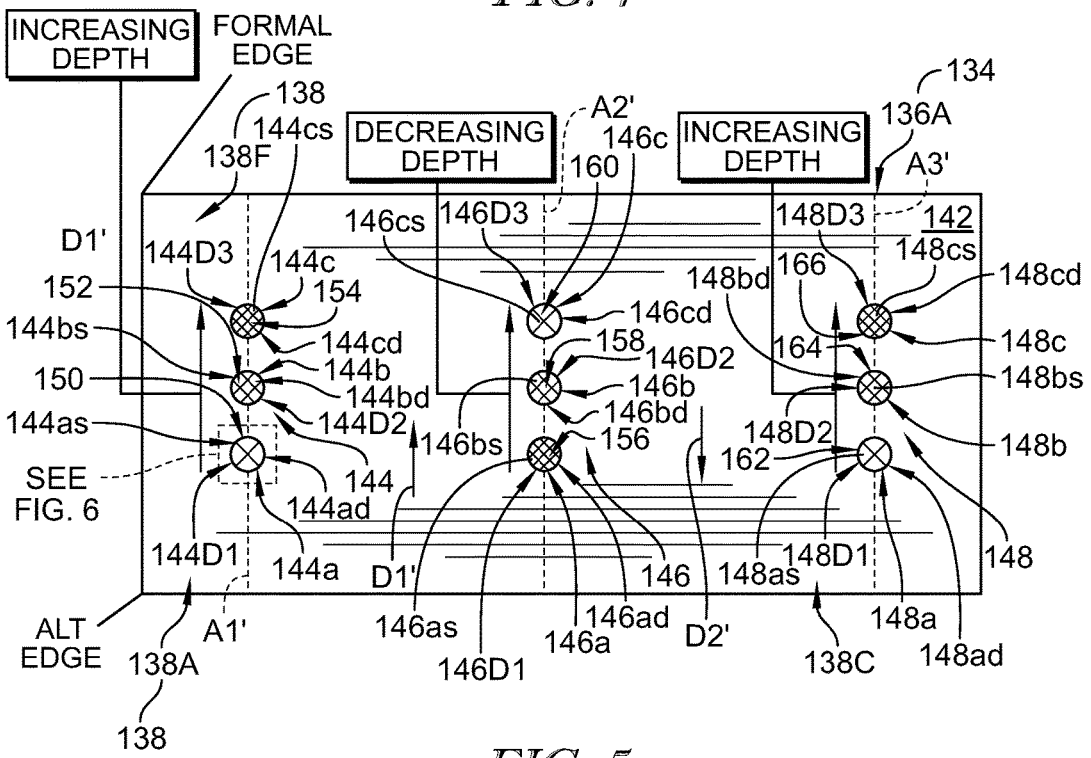
FIG. 5 is a bottom view of another blade track segment adapted for use in the turbine assembly of FIG. 2 showing that the blade track segment includes a first set of rub depth indicators having first depths that are arranged along a first path in an axial direction along a central axis of the turbine assembly such that the first depths successively increase as the first set of rub depth indicators are located adjacent to one another in an axially-forward direction, a second set of rub depth indicators having second depths that are arranged along a second path in the axial direction such that the second depths successively decrease as the first set of rub depth indicators are located adjacent to one another in the axially-forward direction, and a third set of rub depth indicators having third depths that are arranged along a third path in the forward direction such that the third depths successively increase as the third set of rub depth indicators are located adjacent to one another in the forward direction.

Referring now to FIG. 5, an illustrative blade track segment 136A adapted for use in a blade track 134 is shown. The blade track segment 136A may be used in place of the segment 36A described above with reference to FIGS. 2-4.

The illustrative blade track segment 136A includes a set of rub depth indicators 144, a set of rub depth indicators 146, and a set of rub indicators 148 formed in a primary track surface 142 of the segment 136A as shown in FIG. 5. Specifically, the sets of rub depth indicators 144, 146, 148 are embodied as, or otherwise include, features that are machined into, and thus located internally of, the primary track surface 142.

The rub depth indicators 144 are spaced from one another and each have a depth 144D measured from the primary track surface 142 as shown in FIG. 5. The rub depth indicators 146 are spaced from one another and each have a depth 146D measured from the primary track surface 142. The rub depth indicators 148 are spaced from one another and each have a depth 148D measured from the primary track surface 142. Similar to the rub depth indicators 44, 46, the rub depth indicators 144, 146, 148 provide inspection features that may be used to determine rub (or a lack thereof) between blades of a turbine wheel assembly (e.g., the blades 30 of the turbine wheel assembly 22) and the blade track 134.

The illustrative set of rub depth indicators 144 are arranged along a linear pathway A1' in a direction indicated by arrow D1' as shown in FIG. 5. Specifically, as discussed in greater detail below, the rub depth indicators 144 are arranged along the pathway A1' in the direction D1' (axially-forward) such that the depths 144D of the indicators 144 successively increase as the indicators 144 are located adjacent to one another in the direction D1'. The rub depth indicators 144 are spaced from one another along an axis 126 oriented similar to the axis 26.

The illustrative set of rub depth indicators 146 are arranged along a linear pathway A2' in the direction D1' as shown in FIG. 5. Specifically, as discussed in greater detail below, the rub depth indicators 146 are arranged along the pathway A2' in the direction D1' (axially-aft) such that the depths 146D of the indicators 146 successively decrease as the indicators 146 are located adjacent to one another in the direction D1'. The rub depth indicators 146 are spaced from one another along the axis 126.

The illustrative set of rub depth indicators 148 are arranged along a linear pathway A3' in the direction D1' as shown in FIG. 5. Specifically, as discussed in greater detail below, the rub depth indicators 148 are arranged along the pathway A3' in the direction D1' (axially-forward) such that the depths 148D of the indicators 148 successively increase as the indicators 148 are located adjacent to one another in the direction D1'. The rub depth indicators 148 are spaced from one another along the axis 126.

The blade track 134 is illustratively constructed of a ceramic matrix composite material. In one example, the ceramic matrix composite material may include silicon-carbide fibers formed into fabric sheets and a silicon-carbide matrix. In another example, the ceramic matrix composite material may include another ceramic-based material that including reinforcing fibers and a matrix material.

The illustrative blade track segment 136A includes a base portion (not shown) similar to the base portion 38B and a coating 138C similar to the coating 38C applied thereto as shown in FIG. 5. The base portion is formed from a ceramic matrix composite material and the coating 138C is formed from a ceramic-containing material.

The primary track surface 142 and the sets of rub depth indicators 144, 146, 148 are illustratively formed by the coating 138C as shown in FIG. 5. The illustrative coating 138C is abradable and adapted to wear when blades (e.g., the blades 30) rub into the coating 138C such that interference between the blades and the blade track 134 can be determined. The coating 138C is also adapted to withstand the high temperature gasses provided to a turbine assembly (e.g., the turbine assembly 18) during operation thereof. As such, in some embodiments, the coating 138C may be a protective coating such as an environmental barrier coating adapted to resist degradation and protect the base portion during operation of a gas turbine engine (e.g., the engine 10).

The set of rub depth indicators 144 illustratively includes three rub depth indicators 144*a*, 144*b*, 144*c* arranged along the arc A1' in the direction D1' as shown in FIG. 5. The number of rub depth indicators 144 is dependent upon the operational application of the turbine assembly. In some embodiments, another suitable number of rub depth indicators 144 may be provided. In any case, the direction D1' is an axially-forward direction along the axis 126 from an aft portion 138A of a runner 138 defining the primary track surface 142 toward a forward portion 138F of the runner 138. In other embodiments, the direction D1' may be an aftward direction along the axis 126 from the forward portion 138F toward the aft portion 138A.

The illustrative rub depth indicators 144*a*, 144*b*, 144*c* have respective depths 144D1, 144D2, 144D3 measured from the primary track surface 142 that are indicated by respective patterns 144*ad*, 144*bd*, 144*cd* as shown in FIG. 5. The depth 144D2 indicated by the pattern 144*bd* is greater than the depth 144D1 indicated by the pattern 144*ad*. The depth 144D3 indicated by the pattern 144*cd* is greater than the depth 144D2 indicated by the pattern 144*bd*.

The set of rub depth indicators 146 illustratively includes three rub depth indicators 146*a*, 146*b*, 146*c* arranged along the pathway A2' in the direction D1' as shown in FIG. 5. The number of rub depth indicators 146 is dependent upon the operational application of the turbine assembly. In some embodiments, another suitable number of rub depth indicators 146 may be provided. In any case, the pathway A1' and the pathway A2' are circumferentially spaced from one another about the axis 126.

The illustrative rub depth indicators 146*a*, 146*b*, 146*c* have respective depths 146D1, 146D2, 146D3 measured from the primary track surface 142 that are indicated by respective patterns 146*ad*, 146*bd*, 146*cd* as shown in FIG. 5. The depth 146D1 indicated by the pattern 146*ad* is greater than the depth 146D2 indicated by the pattern 146*bd*. The depth 146D2 indicated by the pattern 146*bd* is greater than the depth 146D3 indicated by the pattern 146*cd*.

The set of rub depth indicators 148 illustratively includes three rub depth indicators 148*a*, 148*b*, 148*c* arranged along the pathway A3' in the direction D1' as shown in FIG. 5. The number of rub depth indicators 148 is dependent upon the operational application of the turbine assembly. In some embodiments, another suitable number of rub depth indicators 148 may be provided. In any case, the pathway A1', the pathway A2', and the pathway A3 are circumferentially spaced from one another about the axis 126.

The illustrative rub depth indicators 148*a*, 148*b*, 148*c* have respective depths 148D1, 148D2, 148D3 measured from the primary track surface 142 that are indicated by respective patterns 148*ad*, 148*bd*, 148*cd* as shown in FIG. 5. The depth 148D2 indicated by the pattern 148*bd* is greater than the depth 148D1 indicated by the pattern 148*ad*. The depth 148D3 indicated by the pattern 148*cd* is greater than the depth 148D2 indicated by the pattern 148*bd*.

The illustrative rub depth indicators 144*a*, 144*b*, 144*c* form respective rub indication surfaces 144*as*, 144*bs*, 144*cs* as shown in FIG. 5. The rub depth indication surfaces 144*as*, 144*bs*, 144*cs* are located internally of the primary track surface 142. The rub depth indicators 144*a*, 144*b*, 144*c* are arranged in the direction D1' such that the surfaces 144*as*, 144*bs*, 144*cs* are spaced successively farther from the axis 126 in a radial direction than the primary track surface 142 as the indicators 144*a*, 144*b*, 144*c* are located adjacent to one another in the direction D1'. As such, the surface 144*as* is closer to the axis 126 than the surface 144*bs* and the surface 144*bs* is closer to the axis 126 that the surface 144*cs*.

The illustrative rub depth indicators 146*a*, 146*b*, 146*c* form respective rub indication surfaces 146*as*, 146*bs*, 146*cs* as shown in FIG. 5. The rub depth indication surfaces 146*as*, 146*bs*, 146*cs* are located internally of the primary track surface 142. The rub depth indicators 146*a*, 146*b*, 146*c* are arranged in a direction D2' generally opposite the direction D1' such that the surfaces 146*as*, 146*bs*, 146*cs* are spaced successively farther from the axis 126 in the radial direction than the primary track surface 142 as the indicators 146*a*, 146*b*, 146*c* are located adjacent to one another in the direction D2'. As such, the surface 146*as* is farther from the axis 26 that the surface 146*bs* and the surface 146*bs* is farther from the axis 126 than the surface 146*cs*.

The illustrative rub depth indicators 148*a*, 148*b*, 148*c* form respective rub indication surfaces 148*as*, 148*bs*, 148*cs* as shown in FIG. 5. The rub depth indication surfaces 148*as*, 148*bs*, 148*cs* are located internally of the primary track surface 142. The rub depth indicators 148*a*, 148*b*, 148*c* are arranged in the direction D1' such that the surfaces 148*as*, 148*bs*, 148*cs* are spaced successively farther from the axis 126 in a radial direction than the primary track surface 142 as the indicators 148*a*, 148*b*, 148*c* are located adjacent to one another in the direction D1'. As such, the surface 148*as* is closer to the axis 126 than the surface 148*bs* and the surface 148*bs* is closer to the axis 126 that the surface 148*cs*.

Referring now to FIG. 6, the rub depth indicator 144*a* and the rub indication surface 144*as* are shown in greater detail. The rub depth indicator 144*a* illustratively has a generally circular cross-sectional shape as best seen in FIG. 5. In other embodiments, however, the rub depth indicator 144*a* may take the shape of another suitable geometric form. The rub indication surface 144*as* is illustratively a generally planar surface (also referred to herein as a flat-bottomed surface) defined by an aperture 150 formed in the coating 138C that has a generally circular cross-sectional shape.

In the illustrative embodiment, the rub depth indicators 144*b*, 144*c*, 146*a*, 146*b*, 146*c*, 148*a*, 148*b*, 148*c* have cross-sectional shapes substantially identical to the cross-sectional shape of the indicator 144*a* as shown in FIGS. 5 and 6. Additionally, in the illustrative embodiment, the rub indication surfaces 144*bs*, 144*cs*, 146*as*, 146*bs*, 146*cs*, 148*as*, 148*bs*, 148*cs* are generally planar surfaces defined by respective apertures 152, 154, 156, 158, 160, 162, 164, 166 formed in the coating 138C that have cross-sectional shapes substantially identical to the aperture 150.

Figure 7:
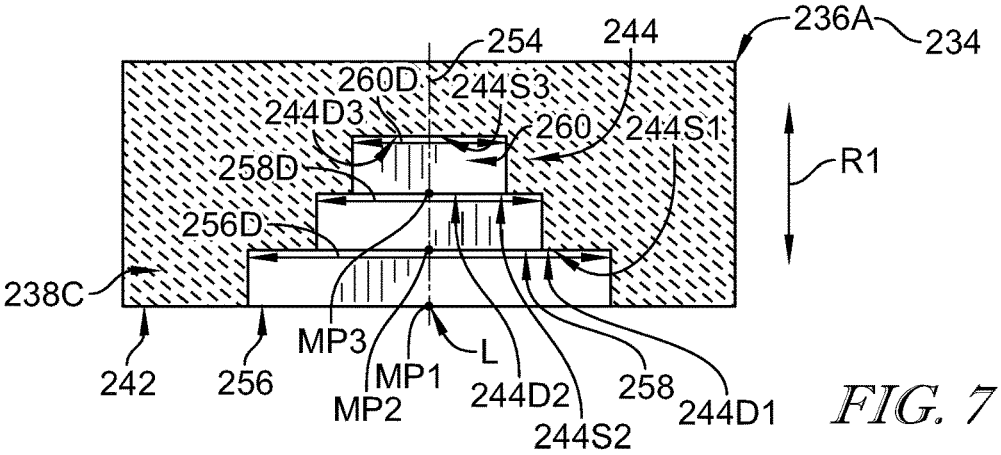
FIG. 7 is a sectional view of another rub depth indicator formed in a blade track segment that is adapted for use in the turbine assembly of FIG. 2.

Referring now to FIG. 7, an illustrative rub depth indicator 244 formed in a primary track surface 242 of a blade track segment 236A of a blade track 234 is shown. The blade track segment 236A may be used in place of the segment 36A described above with reference to FIGS. 2-4 or the segment 136A described above with reference to FIG. 5. The blade track segment 236A may include one or more substantially identical rub depth indicators 244. In embodiments where the segment 236A includes more than one rub depth indicator 244, the indicators 244 may be arranged in similar fashion to the indicators 44, 46 on the segment 36A or the indicators 144, 146, 148 on the segment 136A.

In the illustrative embodiment, the rub depth indicator 244 forms three rub indication surfaces 244S1, 244S2, 244S3 as shown in FIG. 7. The rub indication surfaces 244S1, 244S2, 244S3 are spaced different radial distances from an axis (not shown) defining the centerline of a turbine assembly (e.g., like the axis 26) including the blade track segment 236A. More specifically, the surfaces 244S1, 244S2, 244S3 are spaced successively farther from the axis in a radial direction indicated by arrow R1. In addition, the surfaces 244S1, 244S2, 244S3 are arranged such that midpoints MP1, MP2, MP3 of the respective surfaces 244S1, 244S2, 244S3 are aligned along an axis 254 extending in the radial direction R1 through the segment 236A.

In the illustrative embodiment, because the midpoints MP1, MP2, MP3 of the respective rub indication surfaces 244S1, 244S2, 244S3 are aligned along the axis 254, the surfaces 244S1, 244S2, 244S3 are centered about a location L on the axis 254 as shown in FIG. 7. As such, different rub depths of a turbine wheel assembly (e.g., the assembly 22) into the blade track 234 at and adjacent to the location L caused by turbine wheel assembly rotation within a turbine shroud (e.g., the shroud 24) during operation of the turbine wheel assembly may be determined based on visual observation of the surfaces 244S1, 244S2, 244S3.

In the illustrative embodiment, the rub indication surfaces 244S1 is spaced a radial distance 244D1 from the axis as shown in FIG. 7. The rub indication surface 244S2 is spaced a radial distance 244D2 from the axis greater than the radial distance 244D1. The rub indication surface 244S3 is spaced a radial distance 244D3 from the axis greater than the radial distance 244D2.

In the illustrative embodiment, each of the rub indication surfaces 244S1, 244S2, and 244S3 is a generally planar surface (also referred to herein as a flat-bottomed surface) formed by an abradable, ceramic-containing coating 238C as shown in FIG. 7. The surface 244S1 is defined by an aperture 256 formed in the coating 238C that has a diameter 256D. The surface 244S2 is defined by an aperture 258 formed in the coating 238C that has a diameter 258D less than the diameter 256D. The surface 244S3 is defined by an aperture 260 formed in the coating 238C that has a diameter 260D less than the diameter 258D.

The rub depth indicator 244 may be produced by a series of operations with multiple tool sizes as suggested in FIG. 7. In some embodiments, the rub depth indicator 244 may be produced in one operation by a tool whose profile matches the stepped profile of the feature.

Figure 8:
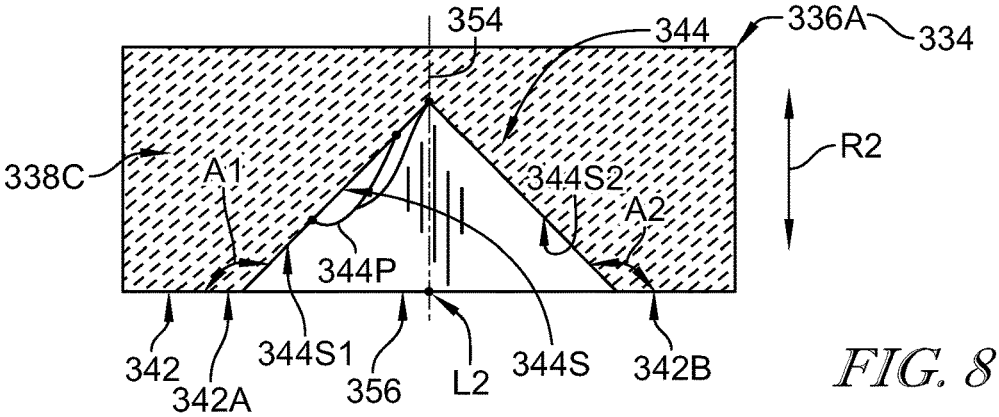
FIG. 8 is a sectional view of yet another rub depth indicator formed in a blade track segment that is adapted for use in the turbine assembly of FIG. 2.

Referring now to FIG. 8, an illustrative rub depth indicator 344 formed in a primary track surface 342 of a blade track segment 336A of a blade track 334 is shown. The blade track segment 336A may be used in place of the segment 36A described above with reference to FIGS. 2-4 or the segment 136A described above with reference to FIG. 5. The blade track segment 336A may include one or more substantially identical rub depth indicators 344. In embodiments where the segment 336A includes more than one rub depth indicator 344, the indicators 344 may be arranged in similar fashion to the indicators 44, 46 on the segment 36A or the indicators 144, 146, 148 on the segment 136A.

In the illustrative embodiment, the rub depth indicator 344 forms a single rub indication surface 344S as shown in FIG. 8. The rub indication surface 344S includes points 344P spaced at different radial distances from an axis (not shown) defining the centerline of a turbine assembly (e.g., like the axis 26) than the primary track surface 342. Each of the points 344P is illustratively spaced farther from the axis than the surface 342 in a radial direction indicated by arrow R2. An axis 354 bisecting the surface 344S passes through a location L2 as shown in FIG. 8.

In the illustrative embodiment, because the rub indication surface 344S is bisected by the axis 354 passing through the location L2, the surface 344S is centered about the location L2 as shown in FIG. 8. As such, different rub depths of a turbine wheel assembly (e.g., the assembly 22) into the blade track 334 at and adjacent to the location L2 caused by turbine wheel assembly rotation within a turbine shroud (e.g., the shroud 24) during operation of the turbine wheel assembly may be determined based on visual observation of the surface 344S.

In the illustrative embodiment, the rub indication surface 344S includes a surface segment 344S1 and a surface segment 344S2 interconnected with the surface segment 344S1 as shown in FIG. 8. The segment 344S1 extends at an obtuse angle A1 to a portion 342A of the primary track surface 342. The segment 344S2 extends at an obtuse angle A2 to a portion 342B of the primary track surface 342.

In the illustrative embodiment, the rub indication surface 344S is a generally planar surface formed by an abradable, ceramic-containing coating 338C as shown in FIG. 8. The surface 344S is defined by an aperture 356 formed in the coating 338C that has a generally conical cross-sectional shape.

Figure 9:
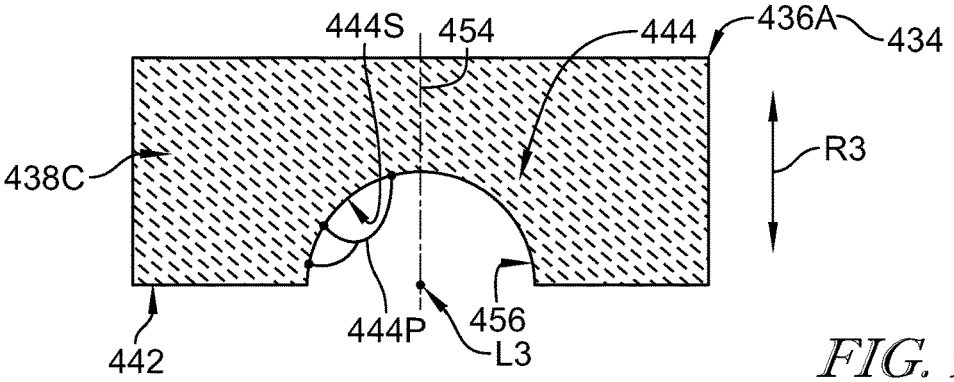
FIG. 9 is a sectional view of yet another rub depth indicator still formed in a blade track segment that is adapted for use in the turbine assembly of FIG. 2.

Referring now to FIG. 9, an illustrative rub depth indicator 444 formed in a primary track surface 442 of a blade track segment 436A of a blade track 434 is shown. The blade track segment 436A may be used in place of the segment 36A described above with reference to FIGS. 2-4 or the segment 136A described above with reference to FIG. 5. The blade track segment 436A may include one or more substantially identical rub depth indicators 444. In embodiments where the segment 436A includes more than one rub depth indicator 444, the indicators 444 may be arranged in similar fashion to the indicators 44, 46 on the segment 36A or the indicators 144, 146, 148 on the segment 136A.

In the illustrative embodiment, the rub depth indicator 444 forms a single rub indication surface 444S as shown in FIG. 9. The rub indication surface 444S includes points 444P spaced at different radial distances from an axis (not shown) defining the centerline of a turbine assembly (e.g., like the axis 26) than the primary track surface 442. Each of the points 444P is illustratively spaced farther from the axis than the surface 442 in a radial direction indicated by arrow R3. An axis 454 bisecting the surface 444S passes through a location L3 as shown in FIG. 9.

In the illustrative embodiment, because the rub indication surface 444S is bisected by the axis 454 passing through the location L3, the surface 444S is centered about the location L3 as shown in FIG. 9. As such, different rub depths of a turbine wheel assembly (e.g., the assembly 22) into the blade track 434 at and adjacent to the location L3 caused by turbine wheel assembly rotation within a turbine shroud (e.g., the shroud 24) during operation of the turbine wheel assembly may be determined based on visual observation of the surface 444S.

In the illustrative embodiment, the rub indication surface 444S is illustratively embodied as, or otherwise includes, an arcuate surface as shown in FIG. 9. The rub indication surface 444S is formed by an abradable, ceramic-containing coating 438C. The surface 444S is defined by an aperture 456 formed in the coating 438C that has a partial oval cross-sectional shape.

A gas turbine engine (e.g., the gas turbine engine 10) may include alternating stages of static vanes and rotating blades (e.g., the blades 30) in compressor (e.g., the compressor 14) and turbine (e.g., the turbine 18) sections of the engine. The rotating blades may impart mechanical energy to the flowpath gasses in the compressor section, and they may extract mechanical energy from the flowpath gasses in the turbine section. In both the compressor and turbine sections, the blades may be fitted to a rotating disk (e.g., the disk 28) or drum. In designs where a shroud (e.g., the turbine shroud 24) is not integral to a blade, the tips of the blade may move past static blade tracks (e.g., the blade track 34) that are positioned just radially outboard of the rotating blades.

The amount of clearance (or lack thereof) between the blade tips and the seal segments or blade tracks may have a substantial impact on aerodynamic efficiency and overall performance of the engine. Without a seal segment radially outboard of the blade, gasses may be free to migrate over the blade tip from a pressure side of the blade to a suction side of the blade without causing the blade to rotate. By minimizing the clearance between the blade tips and the seal segments, aerodynamic losses may be reduced.

Turbine seal segments may have a multi-layer coating system on the radially inboard surface (e.g., the primary track surface 42) that forms an outer annulus of the flowpath. The coating system may include a bond coat applied to a metallic, ceramic (e.g., the base portion 38B), or other suitable substrate, and an abradable coating (e.g., the coating 38C) applied to the bond coat. In some applications, an environmental barrier coating may be applied after the bond coat and before the abradable coating.

The outer abradable coating's purpose may be to act as a sacrificial material so that the turbine blade tips can rub into the surface and leave a minimum gap between the blade tips and outer annulus surface formed by the abradable coating. Since managing tip clearance may be important for achieving high stage efficiencies, measuring the tip clearance at different operating conditions may be done to provide insight into the relative radial position of the blade tips and seal segments at different engine operating conditions. Such measurement may be accomplished by a variety of methods, including, but not limited to, installing tip clearance measurement probes or measuring incursion depth into the abradable coating after disassembly of the engine.

The present disclosure may provide designs for forming negative features (e.g., the rub depth indicators 44, 46) in the abradable coating surface. In one example, flat-bottomed holes (e.g., the indicators 44, 46 having respective surfaces 44*as*, 44*bs*, 44*cs*, 44*ds*, 46*as*, 46*bs*, 46*cs*, 46*ds*) may be machined into the abradable coating surface. A series of separate holes (e.g., the apertures 48, 50, 52, 54, 56, 58, 60, 62) may be produced at varying depths (e.g., the depths 44D1, 44D2, 44D3, 44D4, 46D1, 46D2, 46D3, 46D4) so that the features successively get rubbed away by the blade tips as the incursion depths of the blade tips increase. The rub depth may be revealed by observing which holes are still visible during inspection since the pattern of features and their depths are known. Embodiments of the present disclosure provide for successive disappearance of the features with increasing depth such that the rub depth can be estimated during a borescope inspection by simply counting the remaining features. This does not require the segments to be disassembled from the engine.

One benefit of the flat-bottomed holes may be that the features are less complicated and therefore easier to manufacture with industry standard equipment than other designs. Additionally, the small diameter, flat-bottomed holes may be advantageous for some coatings such as ceramic-containing coatings because the holes can minimize stresses in such brittle, relatively-low bond strength coatings. In some embodiments, the hole feature may include a radius where the cylindrical surface of the hole meets the flat bottom of the hole. The size and shape of the holes may be unique to the abradable coating material itself, and some coatings may be more tolerant to other shapes.

The flat-bottomed holes may be produced in multiple rows of increasing or decreasing incremental depths (e.g., the row of indicators 44*a*, 44*b*, 44*c*, 44*d* and the row of indicators 46*a*, 46*b*, 46*c*, 46*d*). Multiple rows of flat-bottomed holes with depths varying in opposite directions (the directions D1, D2 and the directions D1', D2') may provide indications of rub depth on forward and aft portions (e.g., the portions 138F, 138A) of blade track segments or on circumferentially spaced portions of blade track segments. Such configurations may enable rub depth consistency to be determined over the axial and circumferential dimensions of blade track segments to a greater degree than other configurations permit such rub depth consistency to be determined.

In one example, the depth of the flat-bottomed holes may vary as a function of circumferential position (e.g., the indicators 44, 46 spaced circumferentially about the axis 26 as shown in FIG. 4). In another example, the depth of the flat-bottomed holes may vary as a function of axial position (e.g., the indicators 144, 146, 148 spaced along the axis 126 as shown in FIG. 5). A sectional view of one of the flat-bottomed holes (e.g., one of the indicators 44, 46 or the indicators 144, 146, 148) may be provided by FIG. 6.

In the latter example, the same pattern may be reproduced at differential circumferential positions in the abradable coating (e.g., the indicators 144, 146, 148 are circumferentially spaced about the axis 126). This may be advantageous because the radius of curvature of the blade track segments may change as a result of thermal expansion such that tip clearance and rub depth may not be consistent along a segment's arc length at a given engine condition. A blade track segment's radius of curvature may be different from its radial position, which may be referred to as petalling or faceting depending on whether the blade track segment's radius of curvature is less than or greater than its radial position with respect to the engine centerline (e.g., the centerline defined by the axis 26). Varying the depth of the flat-bottomed holes as a function of axial position may provide insight into the degree of mismatch between the blade track segment's curvature and radial position.

In yet another example, a series of successively smaller diameter and deeper holes (e.g., the apertures 256, 258, 260 defining the rub indicator 244) may be produced in the abradable coating. One benefit of this design may be that multiple features (e.g., the rub indication surfaces 244S1, 244S2, 244S3) occupy a small amount of space such that rub or interference at generally the same precise location may be observed at multiple incursion depths.

In yet another example still, a cone-shaped feature (e.g., the indicator 344 defined by the aperture 356 having a generally conical cross-sectional shape) may be produced in the abradable coating. In this example, the radius may vary with the depth of the machined feature, and the rub depth may be calculated as long as the diameter of the remaining feature can be measured at the coating surface and the correlation between feature depth and feature diameter is known. Other shapes (e.g., the indicator 444 defined by the aperture 456 having a partial oval cross-sectional shape) may offer similar benefits.

The assembly of blade track segments in an engine may form a full annular surface outboard of the blades. The negative coating features contemplated by the present disclosure can be produced in any number of segments forming the full annular surface. Including these features at various circumferential positions around the engine may provide insight into the variation of tip clearance as these positions.

While illustrative embodiments of the present disclosure include blade track segments comprising composite matrix materials, the teachings herein are applicable to metallic blade track segments. In addition, while illustrative blade tracks of the present disclosure are made up of segments, it is contemplated that the rub depth indication systems described herein may be included in full-hoop blade track designs.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A turbine assembly comprising a turbine wheel assembly including a disk and a plurality of blades that extend outwardly from the disk in a radial direction away from an axis, and a turbine shroud that extends around the blades of the turbine wheel assembly to block gases from passing over the blades during operation of the turbine assembly, the turbine shroud including a plurality of blade track segments arranged circumferentially adjacent to one another about the axis to form a ring, each blade track segment having a runner that forms a primary track surface facing the axis and spaced from the axis in the radial direction, wherein (i) at least one of the plurality of blade track segments includes a first set of rub depth indicators spaced from one another and each having a first depth measured from the primary track surface and a second set of rub depth indicators spaced from one another and each having a second depth measured from the primary track surface, (ii) the first set of rub depth indicators and the second set of rub depth indicators are configured such that approximate rub depths of the turbine wheel assembly into the turbine shroud caused by turbine wheel assembly rotation within the turbine shroud during operation of the turbine assembly may be determined based on visual observation of the first set of rub depth indicators and the second set of rub depth indicators, (iii) the first set of rub depth indicators are arranged along a first pathway in a first direction such that the first depths successively increase as the first set of rub depth indicators are located adjacent to one another in the first direction, and (iv) the second set of rub depth indicators are arranged in the first direction along a second pathway such that the second depths successively decrease as the second set of rub depth indicators are located adjacent to one another in the first direction.

2. The turbine assembly of claim 1, wherein the first set of rub depth indicators are circumferentially spaced from one another about the axis and the second set of rub depth indicators are circumferentially spaced from one another about the axis.

3. The turbine assembly of claim 2, wherein the first direction is a clockwise circumferential direction about the axis.

4. The turbine assembly of claim 2, wherein the first direction is a counterclockwise circumferential direction about the axis.

5. The turbine assembly of claim 3, wherein the first pathway and the second pathway are spaced from one another along the axis.

6. The turbine assembly of claim 1, wherein the first set of rub depth indicators are spaced from one another along the axis and the second set of rub depth indicators are spaced from one another along the axis.

7. The turbine assembly of claim 6, wherein the first direction is an axially-forward direction along the axis.

8. The turbine assembly of claim 6, wherein the first direction is an aftward direction along the axis.

9. The turbine assembly of claim 7, wherein the first pathway and the second pathway are circumferentially spaced from one another about the axis.

10. The turbine assembly of claim 1, wherein the primary track surface is formed by an abradable, ceramic-containing coating adapted to withstand high temperatures gases provided to the turbine assembly during operation of the turbine assembly and the first and second sets of rub depth indicators include generally planar surfaces defined by apertures formed in the coating that each have a generally circular cross-sectional shape.

11. A turbine assembly comprising a turbine wheel assembly including a disk and a plurality of blades that extend outwardly from the disk in a radial direction away from an axis, and a turbine shroud that extends around the blades of the turbine wheel assembly to block gases from passing over the blades during operation of the turbine assembly, the turbine shroud including a plurality of blade track segments arranged circumferentially adjacent to one another about the axis to form a ring, each blade track segment having a runner that forms a primary track surface facing the axis and spaced from the axis in the radial direction, wherein (i) at least one of the plurality of blade track segments includes a first set of rub depth indicators that form a first plurality of rub indication surfaces and a second set of rub depth indicators that form a second plurality of rub indication surfaces, (ii) the first set of rub depth indicators and the second set of rub depth indicators are configured such that approximate rub depths of the turbine wheel assembly into the turbine shroud caused by turbine wheel assembly rotation within the turbine shroud during operation of the turbine assembly may be determined based on visual observation of the first plurality of rub indication surfaces and the second plurality of rub indication surfaces, (iii) the first set of rub depth indicators are arranged in a first direction such that the first plurality of rub indication surfaces are spaced successively farther from the axis in the radial direction than the primary track surface as the first set of rub indicators are located adjacent to one another in the first direction, and (iv) the second set of rub depth indicators are arranged in a second direction generally opposite the first direction such that the second plurality of rub indication surfaces are spaced successively farther from the axis in the radial direction than the primary track surface as the second set of rub depth indicators are located adjacent to one another in the second direction.

12. The turbine assembly of claim 11, wherein the first plurality of rub indication surfaces are circumferentially spaced from one another about the axis and the second plurality of rub indication surfaces are circumferentially spaced from one another about the axis.

13. The turbine assembly of claim 12, wherein the first direction is a first circumferential direction about the axis and the second direction is a second circumferential direction about the axis generally opposite the first circumferential direction.

14. The turbine assembly of claim 13, wherein the first set of rub depth indicators and the second set of rub depth indicators are spaced from one another along the axis.

15. The turbine assembly of claim 14, wherein each of the first and second sets of rub depth indicators includes four rub depth indicators.

16. The turbine assembly of claim 11, wherein the first plurality of rub indication surfaces are spaced from one another along the axis and the second plurality of rub indication surfaces are spaced from one another along the axis.

17. The turbine assembly of claim 16, wherein the first direction is a first direction along the axis and the second direction is a second direction along the axis generally opposite the first direction.

18. The turbine assembly of claim 17, wherein the first set of rub depth indicators and the second set of rub depth indicators are spaced circumferentially from one another about the axis.

19. The turbine assembly of claim 18, wherein each of the first and second sets of rub depth indicators includes three rub depth indicators.

20. A turbine assembly comprising a turbine wheel assembly including a disk and a plurality of blades that extend outwardly from the disk in a radial direction away from an axis, and a turbine shroud that extends around the blades of the turbine wheel assembly to block gases from passing over the blades during operation of the turbine assembly, the turbine shroud including a blade track having a runner that forms a primary track surface facing the axis and arranged outward of the plurality of blades in the radial direction, wherein (i) the blade track includes a first set of rub depth indicators spaced from one another and each having a depth measured from the primary track surface and a second set of rub depth indicators spaced from one another and each having a depth measured from the primary track surface, (ii) the first set of rub depth indicators and the second set of rub depth indicators are configured such that approximate rub depths of the turbine wheel assembly into the turbine shroud caused by turbine wheel assembly rotation within the turbine shroud during operation of the turbine assembly may be determined based on visual observation of the first set of rub depth indicators and the second set of rub depth indicators, (iii) the first set of rub depth indicators are arranged along a first pathway in a first direction such that the depth of each rub depth indicator included in the first set of rub depth indicators is deeper than the last as the first set of rub depth indicators are located adjacent to one another in the first direction, and (iv) the second set of rub depth indicators are arranged in the first direction along a second pathway in the first direction and the depth of each rub depth indicator included in the second set of rub depth indicators is shallower than the last as the second set of rub depth indicators are located adjacent to one another in the first direction.

* * * * *